US008091177B2

(12) United States Patent
Coté et al.

(10) Patent No.: US 8,091,177 B2
(45) Date of Patent: Jan. 10, 2012

(54) AXIAL-FLOW FAN

(75) Inventors: F. Raymond Coté, Dover, MA (US); Mark D. Caplan, Westborough, MA (US); Sebastian Hansen, Sasbach (DE)

(73) Assignee: Robert Bosch GmbH, Stuttgart (DE)

( * ) Notice: Subject to any disclaimer, the term of this patent is extended or adjusted under 35 U.S.C. 154(b) by 106 days.

(21) Appl. No.: 12/779,680

(22) Filed: May 13, 2010

(65) Prior Publication Data

US 2011/0280729 A1 Nov. 17, 2011

(51) Int. Cl.
*F04D 29/38* (2006.01)

(52) U.S. Cl. ..... 16/203; 416/169 A; 416/189; 416/234; 416/241 R

(58) Field of Classification Search ..... 416/169 A, 416/189, 234, 241 R, 203
See application file for complete search history.

(56) References Cited

U.S. PATENT DOCUMENTS

| | | | | |
|---|---|---|---|---|
| 3,622,249 | A | 11/1971 | Hayashi et al. | |
| 3,642,382 | A | 2/1972 | Hayashi | |
| 4,169,693 | A | 10/1979 | Brubaker | |
| 4,358,245 | A | 11/1982 | Gray | |
| 4,671,739 | A | 6/1987 | Read et al. | |
| 4,684,324 | A * | 8/1987 | Perosino | 416/189 |
| 4,915,588 | A * | 4/1990 | Brackett | 416/189 |
| 5,066,196 | A | 11/1991 | Morofushi | |
| 5,193,981 | A | 3/1993 | Scheidel et al. | |
| 5,236,306 | A | 8/1993 | Hozak | |
| 5,244,347 | A | 9/1993 | Gallivan et al. | |
| 5,326,225 | A | 7/1994 | Gallivan et al. | |
| 5,458,465 | A | 10/1995 | von Wieser et al. | |
| 5,577,888 | A | 11/1996 | Capdevila et al. | |
| 5,645,401 | A | 7/1997 | Martin et al. | |
| 5,769,607 | A * | 6/1998 | Neely et al. | 416/189 |
| 5,871,335 | A | 2/1999 | Bartlett | |
| 5,967,764 | A | 10/1999 | Booth et al. | |
| 6,350,104 | B1 | 2/2002 | Moreau et al. | |

(Continued)

FOREIGN PATENT DOCUMENTS

FR 2848619 6/2004

OTHER PUBLICATIONS

International Search Report and Written Opinion from The International Searching Authority for PCT/US2011/034873 dated Aug. 8, 2011, 9 pages.

(Continued)

*Primary Examiner* — Ninh H Nguyen
(74) *Attorney, Agent, or Firm* — Michael Best & Friedrich LLP

(57) ABSTRACT

A fan includes a hub and blades. A first edge of each blade is proximate an open end of the hub. A first rib is coupled to the hub and substantially aligned with a first plane intersecting the central axis and an intersection of the first edge of the first blade with the hub. The first plane is angularly spaced from a reference plane intersecting the central axis and an intersection of the first edge of the second blade with the hub. An angular spacing between the first plane and the reference plane defines one sector. A second rib is aligned with a second plane angularly positioned between the first plane and the reference plane at a location less than or equal to about (1/nR−0.05) sectors from the first plane, in which nR equals the number of ribs divided by the number of blades.

21 Claims, 5 Drawing Sheets

U.S. PATENT DOCUMENTS

| | | | | |
|---|---|---|---|---|
| 6,375,427 | B1 | 4/2002 | Williams et al. | |
| 6,382,915 | B1 | 5/2002 | Aschermann et al. | |
| 6,579,063 | B2 * | 6/2003 | Stairs et al. | 416/169 A |
| 6,830,434 | B2 | 12/2004 | Kondo et al. | |
| 7,244,110 | B2 | 7/2007 | Hong et al. | |
| 2003/0086787 | A1 | 5/2003 | Kondo et al. | |
| 2007/0199784 | A1 | 8/2007 | Smith et al. | |
| 2007/0278060 | A1 | 12/2007 | Kennedy et al. | |
| 2009/0208333 | A1 | 8/2009 | Smith et al. | |

OTHER PUBLICATIONS

Fig. A—admitted prior art axial-flow fan available at least as early as May 9, 2009.

* cited by examiner

AXIAL-FLOW FAN

FIELD OF THE INVENTION

The present invention relates to fans, and more particularly to axial-flow fans of the type used in automobiles for engine cooling.

BACKGROUND OF THE INVENTION

Axial-flow fans are commonly used in automobiles for engine cooling. The fans are typically injection molded from plastic and include a hub and air-moving blades that extend radially from the hub. An optional band may be present that encircles the ends or tips of the blades. It is known to integrally form the hub with reinforcing ribs.

SUMMARY OF THE INVENTION

The present invention provides, in one aspect, an axial-flow fan including a hub having an open end and a substantially closed end. The hub defines a central axis about which the fan rotates. The fan further includes a plurality of blades coupled to the hub and extending radially outwardly from the hub. Each blade has a root coupled to the hub and a tip spaced from the hub. A first edge of the blade is proximate the open end of the hub and interconnects the root and the tip. The first edge defines one of a leading edge and a trailing edge with respect to a rotational direction of the hub about the central axis. A second edge of the blade is proximate the substantially closed end of the hub and interconnects the root and the tip. The second edge defines the other of the leading edge and the trailing edge. The fan further includes a plurality of ribs coupled to the hub, including a first rib substantially aligned with a first plane intersecting the central axis and an intersection of the first edge of a first of the plurality of blades with the hub, at the root of the first blade. An angular spacing between the first plane and a reference plane intersecting the central axis and an intersection of the first edge of a second of the plurality of blades with the hub, at the root of the second blade, defines one sector. A second rib is substantially aligned with a second plane angularly positioned between the first plane and the reference plane at a location less than or equal to about (1/nR−0.05) sectors from the first plane, in which nR equals the number of ribs divided by the number of blades. The entire root of the first blade is positioned on a first side of the second plane, and the entire root of the second blade is positioned on a second side of the second plane opposite the first side.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
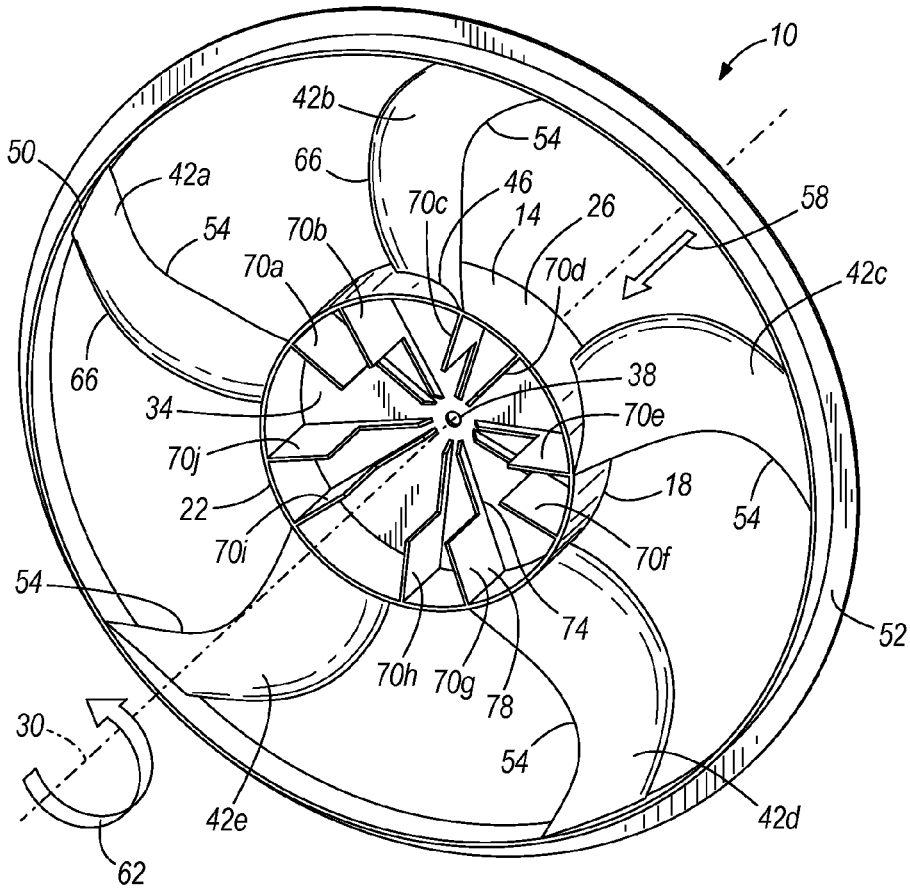
FIG. 1 is a perspective view of an axial-flow fan embodying the present invention.
Figure 2:
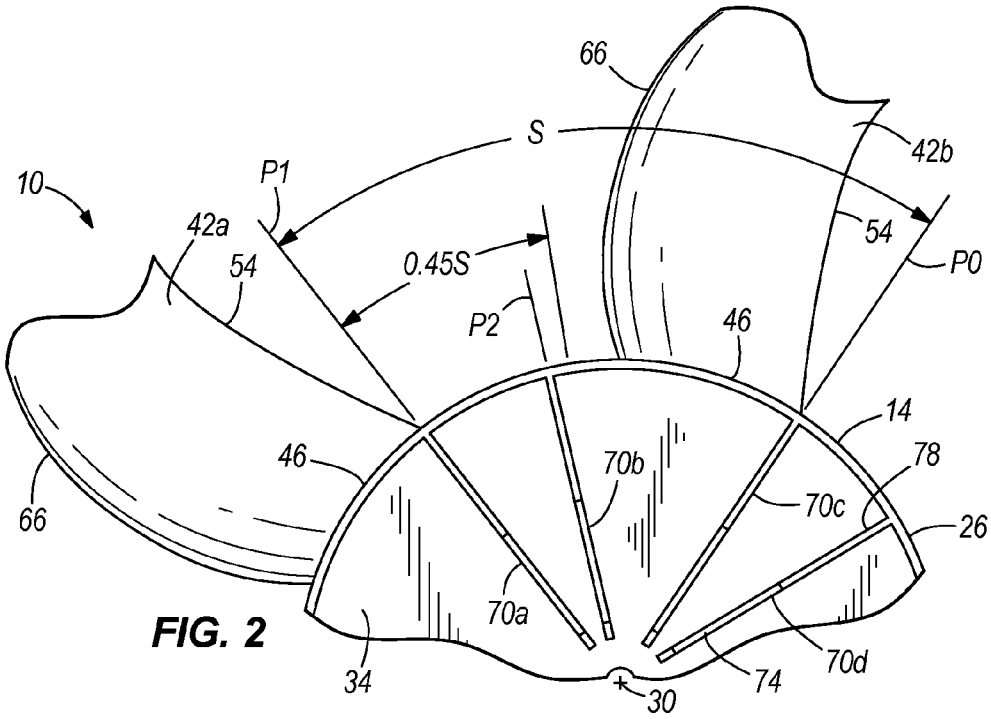
FIG. 2 is a partial end view of the fan of FIG. 1.

FIGS. 1 and 2 illustrate a first embodiment of an axial-flow fan 10 of the present invention. The illustrated fan 10 is used in an automobile for cooling the engine. However, the fan 10 can be used for other applications as well. The fan 10 includes a hub 14 having a substantially closed end 18, and an open end 22. The hub 14 includes a cylindrical wall or cylindrical portion 26 that defines a central axis 30 of the hub 14, about which the fan 10 rotates. The hub 14 further includes a face portion or wall 34 that defines the substantially closed end 18. The illustrated face portion 34 includes an aperture 38 for receiving an output shaft of an electric motor (not shown) that drives the fan 10.

A plurality of blades 42 (individually labeled as 42*a-e*) extend radially outwardly from the hub 14. Each blade 42 has a blade root 46, where the blade 42 couples to the cylindrical portion 26 of the hub 14, and a blade tip 50 spaced from the root 46, and thereby spaced from the hub 14. An optional band 52 may be present that encircles the tips 50 of the blades. In other embodiments, the band 52 may be omitted. A first edge 54 of each blade 42 is the edge proximate the open end 22 of the hub 14 and that interconnects the root 46 and the tip 50. The first edge 54 defines one of the leading edge and the trailing edge of the blade 42, and in the embodiment shown in FIGS. 1 and 2, defines the trailing edge of the blade 42. The arrow 58 in FIG. 1 illustrates the direction of airflow through the fan 10, while the arrow 62 illustrates the direction of fan rotation about the central axis 30. A second edge 66 of each blade 42 is the edge proximate the closed end 18 of the hub 14 and that interconnects the root 46 and the tip 50. The second edge 66 defines the other one of the leading edge and the trailing edge of the blade 42, and in the embodiment shown in FIGS. 1 and 2, defines the leading edge of the blade 42.

While the illustrated fan 10 includes five blades 42*a-e* and a particular orientation of the blades 42, in which the open end 22 of the hub 14 faces in a downstream direction with respect to the direction of airflow 58, the invention is not limited to this blade configuration. For example, and as will be discussed below, different numbers of blades can be used. Additionally, different embodiments may be designed for different axial airflow directions, and therefore different rotational directions of the fans, thereby changing the orientation of the blades. For example, in other embodiments the first edge of the blade might be the leading edge, while the second edge of the blade might be the trailing edge.

The fan 10 further includes a plurality of ribs 70*a-j* coupled to the hub 14. The ribs 70*a-j* reinforce the hub 14 to reduce the deflection and stresses in the fan 10 that arise during operation. In the present invention, the ribs 70*a-j* are positioned to reduce stresses in the hub 14 in a region proximate to the intersection with the first edge 54 of each blade 42, (i.e., the edge of the blade 42 proximate the open end 22 of the hub 14).

Referring now to FIG. 2, a first rib 70*a* is coupled to the hub 14 and is substantially aligned with a first plane P1 that intersects the central axis 30 and an intersection point of the first edge 54 of the first blade 42*a* with the cylindrical portion 26 of the hub 14. As used herein and in the appended claims, the phrase "substantially aligned", as used to describe the alignment of a rib with a plane, means that the radial centerline of the rib can be within plus or minus four degrees of the plane. As shown in FIGS. 1 and 2, the planes are perfectly aligned with the radial centerline of the ribs, but this need not be the case (see e.g., FIGS. 5 and 6).

The first plane P1 is angularly spaced from a reference plane P0 that intersects the central axis 30 and an intersection point of the first edge 54 of the second blade 42*b* with the cylindrical portion 26 of the hub 14. An angular spacing between the first plane P1 and the reference plane P0 (in a clockwise direction from P1 to P0 as shown in FIG. 2) defines one sector S of the fan 10. A second rib 70*b* is coupled to the hub 14 and is substantially aligned with a second plane P2 that intersects the central axis 30 and that is angularly positioned between the first plane P1 and the reference plane P0 at a location less than or equal to about (1/nR−0.05) sectors from the first plane P1, in which nR equals the number of ribs 70 on the fan 10 divided by the number of blades 42 on the fan 10. In the illustrated embodiment of the fan 10 in FIGS. 1 and 2, the fan 10 includes ten ribs 70*a-j* and five blades 42*a-e*. Accordingly, nR equals two, and the second plane P2 is angularly positioned at a location less than or equal to about 0.45 sectors from the first plane P1. More particularly, in FIG. 2, the second plane P2 is about 0.35 sectors from the first plane P1.

In some embodiments, the second plane P2 is angularly positioned between the first and the reference planes P1, P0 at a location less than or equal to about 0.30 sectors from the first plane P1. In yet other embodiments, the second plane P2 is angularly positioned between the first and the reference planes P1, P0 at a location between about 0.15 and about 0.35 sectors from the first plane P1. In further embodiments, the second plane P2 is also at a location greater than or equal to about 0.05 sectors from the first plane P1. The specific location of the second plane P2, and hence the second rib 70*b*, can be optimized based upon particular design and/or operational characteristics of the fan 10. However, placing the second rib 70*b* within 0.45 sectors of the first plane P1, as shown in FIG. 2, helps provide targeted reinforcement to the hub 14 in the region proximate the intersection of the first edges 54 with the cylindrical portion 26 to reduce the deflection of the hub 14 and the resultant stresses in the hub 14. It can be noted that in some embodiments, the second plane P2 need not intersect the central axis 30, which would be the case if the rib 70*b* were not oriented in a truly radial manner relative to the cylindrical portion 26 of the hub 14. However, the rib 70*b* could still be positioned at the locations set forth above.

Referring again to FIG. 1, a third rib 70*c* is coupled to the hub 14 and is substantially aligned with the reference plane P0. The first rib 70*a*, the second rib 70*b*, and the third rib 70*c* together define a first 3-rib grouping pattern spanning one sector S of the hub 14. The 3-rib grouping pattern is repeated around the entire three hundred-sixty degrees of the hub 14 such that there is an identical 3-rib grouping pattern for each blade 42 of the fan. Specifically, the ribs 70*c*, 70*d*, and 70*e* form a second 3-rib grouping pattern that is identical to the first 3-rib grouping pattern. Note that the third rib 70*c* is part of the first 3-rib grouping pattern, but is also part of the second 3-rib grouping pattern. Likewise, the ribs 70*e*, 70*f*, and 70*g* form an identical third 3-rib grouping pattern, the ribs 70*g*, 70*h*, and 70*i* form an identical fourth 3-rib grouping pattern, and the ribs 70*i*, 70*j*, and 70*a* form an identical fifth 3-rib grouping pattern. The number of 3-rib grouping patterns corresponds to the number of blades 42, i.e., there are five blades 42 and five 3-rib grouping patterns. There are also five sectors S defined by the fan 10 around the three hundred-sixty degrees of the hub 14 (one sector S equals seventy-two degrees in the illustrated embodiment). The number of sectors S also correlates to the number of blades 42.

Of further significance is the number of ribs per sector S. There are five sectors S and ten ribs 70*a-j*. Therefore, the fan 10 can be said to have two ribs per sector S. In this regard, the ribs 70*a* and 70*b* can be associated with a first sector S, while the ribs 70*c* and 70*d* can be associated with a second sector S, and so forth. The sectors S are defined by the planes (e.g., P1 and P0), and not necessarily the ribs. In other embodiments, such as some of those to be discussed below, there can be at least two ribs per sector (e.g., three or more ribs per sector S). Since the number of sectors S is also equal to the number of blades 42, the fan 10 can also be said to have at least two ribs per blade.

As also seen in FIGS. 1 and 2, the entire root 46 of the first blade 42*a* is positioned on a first side of the second plane P2 (and therefore of the second rib 70*b*), while the entire root 46 of the second blade 42*b* is on a second side of the second plane P2 (and therefore the second rib 70*b*) opposite the first side. Therefore, the second rib 70*b* is positioned angularly between the first and second blades 42*a*, 42*b*, and not within the vicinity of the cylindrical portion 26 where the root 46 of either of the first or second blades 42*a*, 42*b* joins the hub 14.

Each rib 70*a-j* includes a radially-extending portion 74 coupled to the face portion 34 of the hub 14, and an axially-extending portion 78 coupled to the cylindrical portion 26 of the hub 14. The configurations of the portions 74 and 78 can vary depending upon the size and shape of the motor and/or motor housing, which are positioned at least partially within the open end 22 of the hub 14 when the fan 10 is assembled with the motor.

Figure 3:
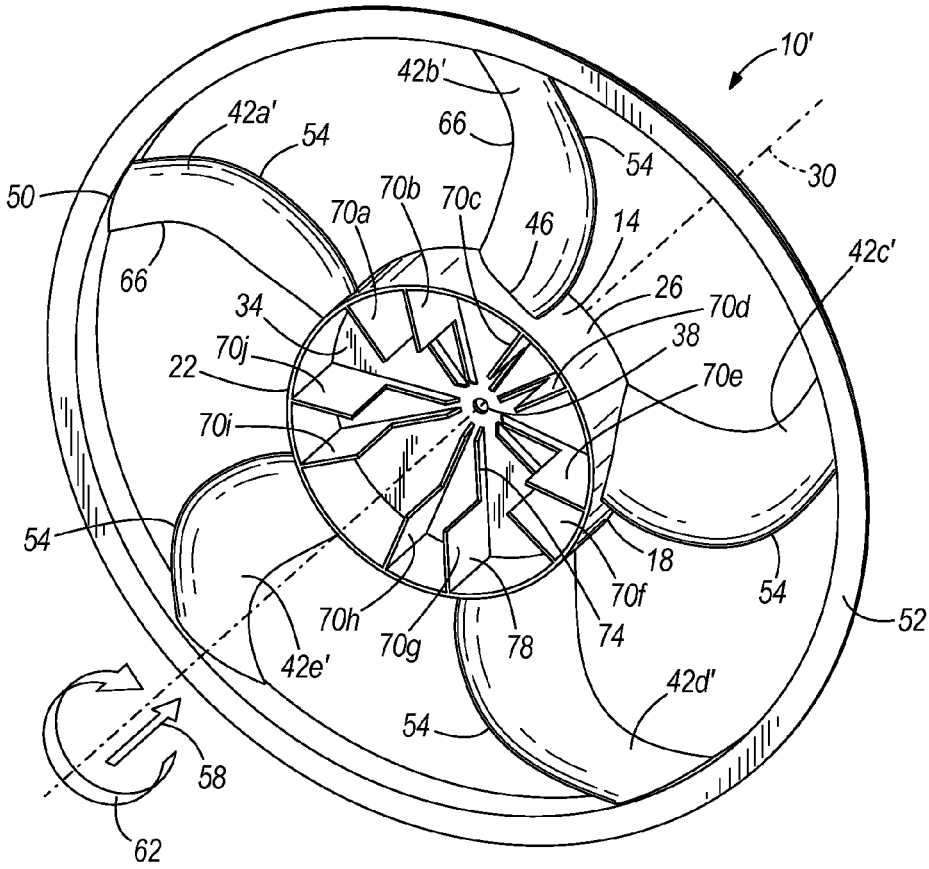
FIG. 3 is a perspective view of an axial-flow fan that is a second embodiment of the present invention.
Figure 4:
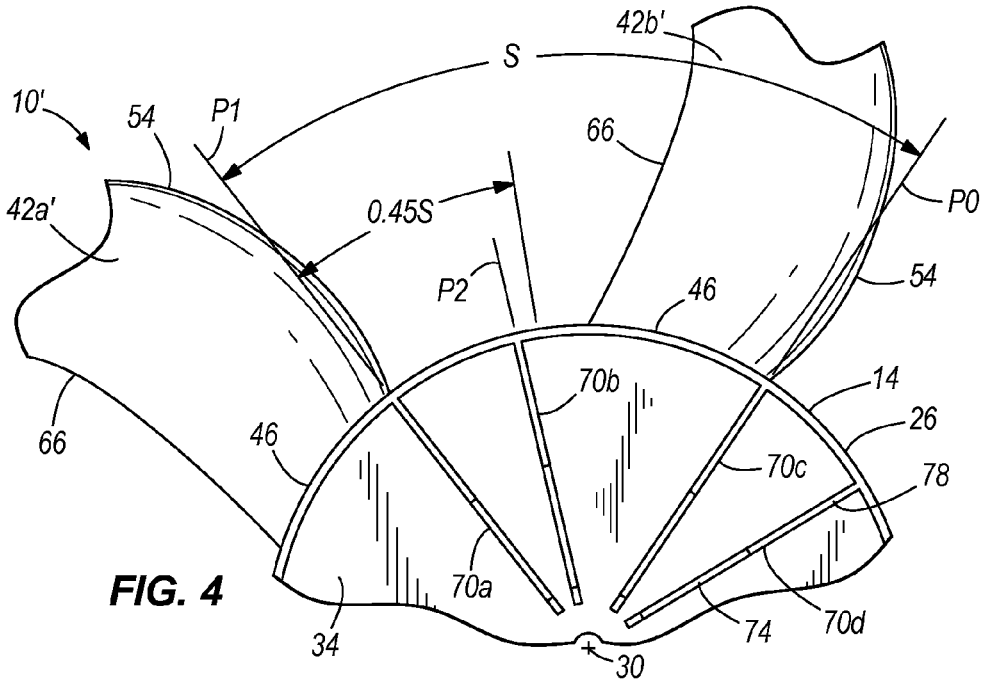
FIG. 4 is a partial end view of the fan of FIG. 3.

FIGS. 3 and 4 illustrate a fan 10' that is a second embodiment of the invention and that is similar to the fan 10. Like parts have been given like reference numerals. The major distinction is that the fan 10' is designed to have the open end 22 of the hub 14 on the upstream side of the airflow, as illustrated by the arrow 58. The direction of rotation of the fan 10' is reversed from that of the fan 10, as illustrated by the arrow 62. Furthermore, the orientation of the blades 42' is reversed such that the first edge 54 (the edge closest to the open end 22 of the hub 14) of each blade 42' is now the leading edge, and the second edge 66 (the edge closest to the substantially closed end 18 of the hub 14) of each blade 42' is now the trailing edge. However, the positioning of the ribs 70*a-j*, the planes P1, P2, P0, and the determination of the sectors S remain the same, as dictated relative to the first edges 54 of the blades 42'. The positional relationships described above with respect to the fan 10 are the same for the fan 10'. Once again, the positioning of the ribs 70*a-j* relative to the first edges 54 of the blades 42', as shown and described, provides improved deflection resistance and stress reduction over prior art arrangements.

Figure 5:
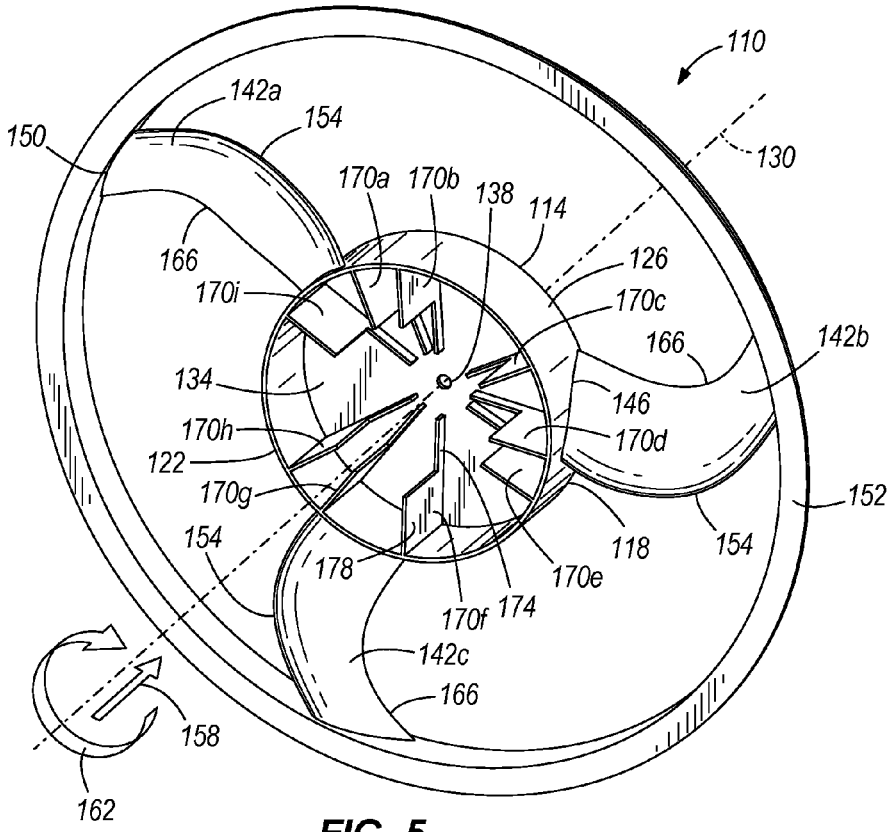
FIG. 5 is a perspective view of an axial-flow fan that is a third embodiment of the present invention.
Figure 6:
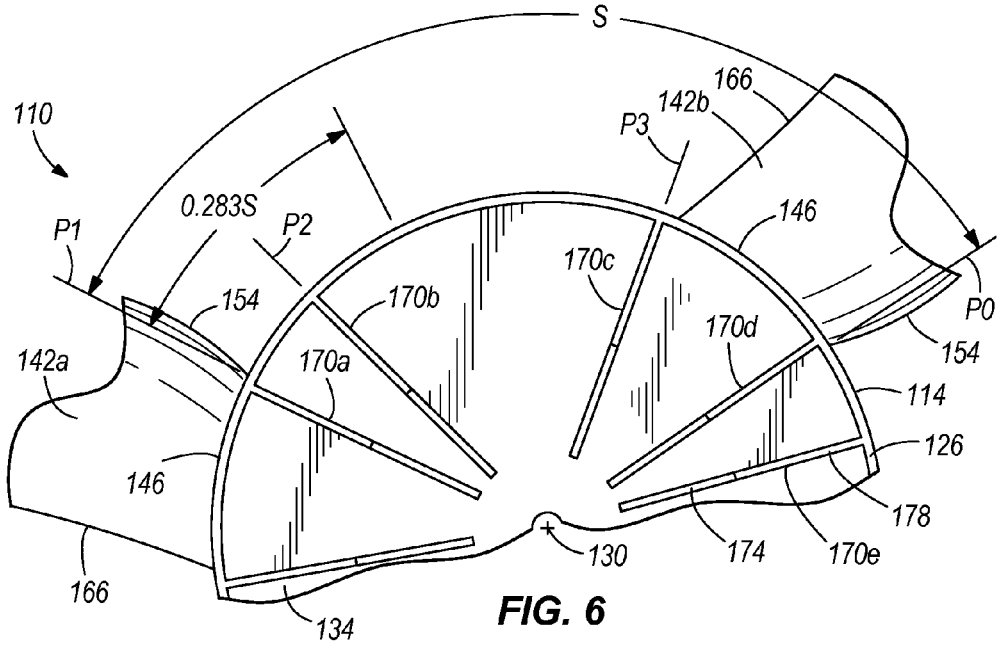
FIG. 6 is a partial end view of the fan of FIG. 5.

FIGS. 5 and 6 illustrate a fan 110 that is a third embodiment of the invention. Features of the fan 110 that are similar to the fans 10 and 10' have been given the same reference numerals of the one-hundred series. The orientation of the fan 110 is similar to that of the fan 10' in terms of the airflow direction (see arrow 158), the direction of rotation (see arrow 162), and the orientation of the blades 142 (individually labeled as 142*a-c*). Specifically, the first edge 154 (the edge closest to the open end 122 of the hub 114) of each blade 142 is the leading edge, and the second edge 166 (the edge closest to the substantially closed end 118 of the hub 114) of each blade 142 is the trailing edge. The fan 110 includes only three blades 142*a-c*.

Nine ribs 170*a-i* are coupled to the hub 114. As shown in FIG. 6, a first rib 170*a* is coupled to the hub 114 and is substantially aligned with a first plane P1 that intersects the central axis 130 and an intersection point of the first edge 154 of the first blade 142*a* with the cylindrical portion 126 of the hub 114. As used herein and in the appended claims, the phrase "substantially aligned", as used to describe the alignment of a rib with a plane, means that the radial centerline of the rib can be within plus or minus four degrees of the plane.

The first plane P1 is angularly spaced from a reference plane P0 that intersects the central axis 130 and an intersection point of the first edge 154 of the second blade 142*b* with the cylindrical portion 126 of the hub 114. As shown in FIG. 6, the planes P1 and P0 are substantially aligned with the radial centerlines of the ribs 170*a*, 170*d*, respectively. An angular spacing between the first plane P1 and the reference plane P0 (in a clockwise direction from P1 to P0 as shown in FIG. 6) defines one sector S. A second rib 170*b* is coupled to the hub 114 and is substantially aligned with a second plane P2 that intersects the central axis 130 and that is angularly positioned between the first plane P1 and the reference plane P0 at a location less than or equal to about (1/nR−0.05) sectors from the first plane P1, in which nR equals three (i.e., nine ribs 170*a-i* divided by three blades 142*a-c*). Accordingly, the second plane P2 is angularly positioned at a location less than or equal to about 0.283 sectors from the first plane P1. More particularly, in FIG. 6, the second plane P2 is about 0.15 sectors from the first plane P1.

In some embodiments, the second plane P2 is angularly positioned between the first and the reference planes P1, P0 at a location between about 0.14 and about 0.21 sectors from the first plane P1. In further embodiments, the second plane P2 is also at a location greater than or equal to about 0.05 sectors from the first plane P1. The specific location of the second plane P2, and hence the second rib 170*b*, can be optimized based upon particular design and/or operational characteristics of the fan 110. However, placing the second rib 170*b* within 0.283 sectors of the first plane P1 helps provide targeted reinforcement to the hub 114 in the region proximate the intersection of the first edges 154 with the cylindrical portion 126 to reduce the deflection of the hub 114 and the resultant stresses in the hub 114. It can be noted that in some embodiments, the second plane P2 need not intersect the central axis 130, which would be the case if the rib 170*b* were not oriented in a truly radial manner relative to the cylindrical portion 126 of the hub 114. However, the rib 170*b* could still be positioned at the locations set forth above.

With continued reference to FIG. 6, a third rib 170*c* is coupled to the hub 114 and is substantially aligned with a third plane P3 that intersects the central axis 130 and that is angularly positioned between the second and the reference planes P2, P0. In some embodiments, the second plane P2 and the third plane P3 are spaced from one another by at least about four degrees. In FIG. 6, the second and third planes P2 and P3 are shown spaced apart by about seventy degrees. In some embodiments, the third plane P3 may lie between an intersection of the second edge 166 of the second blade 142*b* with the hub 114 and an intersection of the first edge 154 of the second blade 142*b* with the hub 114 (i.e., within the span of the root 146 of the second blade 142*b*; see FIG. 8). The fourth rib 170*c* provides additional reinforcement to the hub 114.

A fourth rib 170*d* is coupled to the hub 114 and is substantially aligned with the reference plane P0. The first rib 170*a*, the second rib 170*b*, the third rib 170*c*, and the fourth rib 170*d* together define a first 4-rib grouping pattern spanning one sector S of the hub 114. The 4-rib grouping pattern is repeated around the entire three hundred-sixty degrees of the hub 114 such that there is an identical 4-rib grouping pattern for each blade 142 of the fan. Specifically, the ribs 170*d*, 170*e*, 170*f*, and 170*g* form a second 4-rib grouping pattern that is identical to the first 4-rib grouping pattern. Note that the fourth rib 170*d* is part of the first 4-rib grouping pattern, but is also part of the second 4-rib grouping pattern. Likewise, the ribs 170*g*, 170*h*, 170*i*, and 170*a* form an identical third 4-rib grouping pattern. The number of 4-rib grouping patterns corresponds to the number of blades 142, i.e., there are three blades 142 and three 4-rib grouping patterns. The number of sectors S also correlates to the number of blades 142.

Of further significance is the number of ribs per sector S. There are three sectors S and nine ribs 170*a-i*. Therefore, the fan 110 can be said to have three ribs per sector S. In this regard, the ribs 170*a*, 170*b*, and 170*c* can be associated with a first sector S, while the ribs 170*d*, 170*e* and 170*f* can be associated with a second sector S. The sectors S are defined by the planes (e.g., P1 and P0), and not necessarily the ribs. In other embodiments, there can be at least three ribs per sector (e.g., four or more ribs per sector S). Since the number of sectors S is also equal to the number of blades 142, the fan 110 can also be said to have at least three ribs per blade.

As also seen in FIGS. 5 and 6, the entire root 146 of the first blade 142*a* is positioned on a first side of the second plane P2 (and therefore of the second rib 170*b*), while the entire root 146 of the second blade 142*b* is on a second side of the second plane P2 (and therefore the second rib 170*b*) opposite the first side. Therefore, the second rib 170*b* is positioned angularly between the first and second blades 142*a*, 142*b*, and not within the vicinity of the cylindrical portion 126 where the root 146 of either of the first or second blades 142*a*, 142*b* joins the hub 114.

Figure 7:
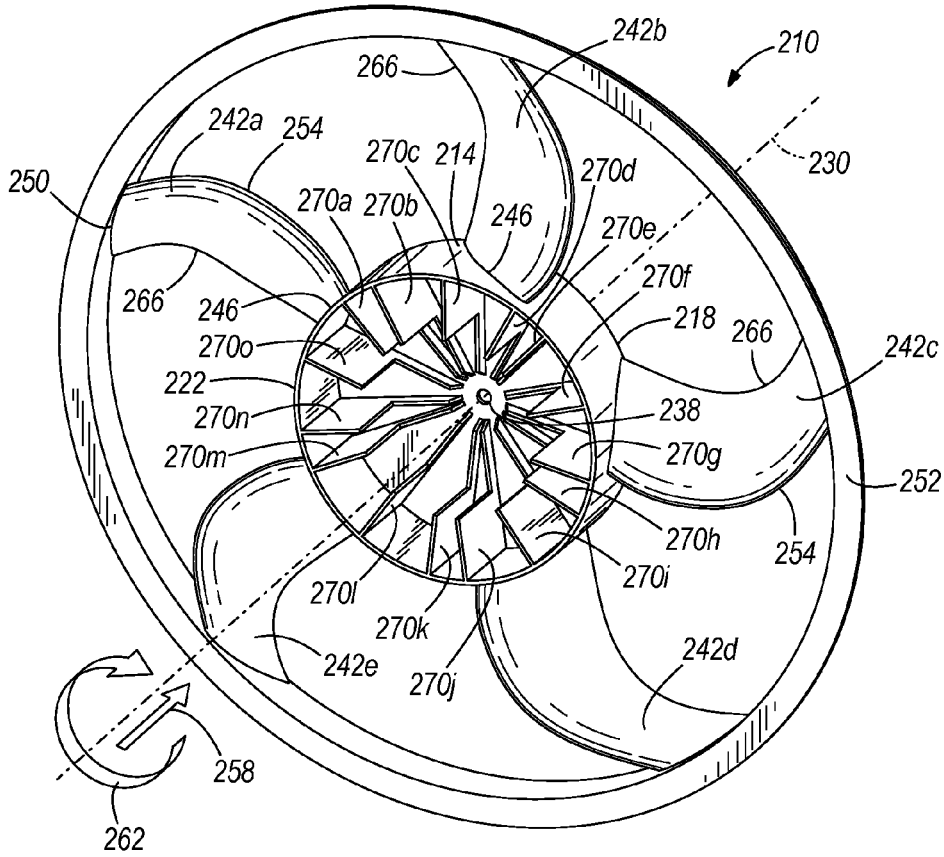
FIG. 7 is a perspective view of an axial-flow fan that is a fourth embodiment of the present invention.
Figure 8:
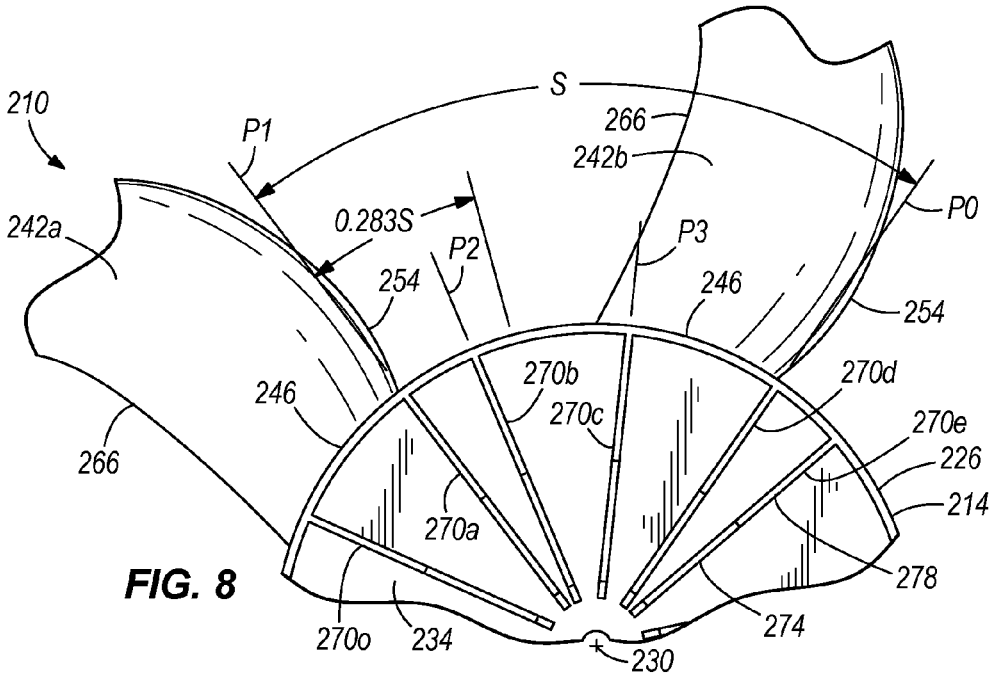
FIG. 8 is a partial end view of the fan of FIG. 7.

FIGS. 7 and 8 illustrate a fan 210 that is a fourth embodiment of the invention. The fan 210 is similar to the fan 10' in terms of the number and orientation of the fan blades, the airflow direction, and the direction of rotation, and is similar to the fan 110 in terms of the positioning or grouping of the ribs. Features of the fan 210 that are similar to the fans 10' and 110 have been given the same reference numerals of the two-hundred series.

As shown in FIG. 7, fifteen ribs 270*a-o* are coupled to the hub 214. As shown in FIG. 8, a first rib 270*a* is coupled to the hub 214 and is substantially aligned with a first plane P1 that intersects the central axis 230 and an intersection point of the first edge 254 of the first blade 242*a* with the cylindrical portion 226 of the hub 214. As used herein and in the appended claims, the phrase "substantially aligned", as used to describe the alignment of a rib with a plane, means that the radial centerline of the rib can be within plus or minus four degrees of the plane.

The first plane P1 is angularly spaced from a reference plane P0 that intersects the central axis 230 and an intersection point of the first edge 254 of the second blade 242*b* with the cylindrical portion 226 of the hub 214. As shown in FIG. 8, the planes P1 and P0 are substantially aligned with the radial centerlines of the ribs 270*a* and 270*d*, respectively. An angular spacing between the first plane P1 and the reference plane P0 (in a clockwise direction from P1 to P0 as shown in FIG. 8) defines one sector S. A second rib 270*b* is coupled to the hub 214 and is substantially aligned with a second plane P2 that intersects the central axis 230 and that is angularly positioned between the first plane P1 and the reference plane P0 at a location less than or equal to about (1/nR−0.05) sectors from the first plane P1, in which nR equals three (i.e., fifteen ribs 270*a-o* divided by five blades 242*a-e*). Accordingly, the second plane P2 is angularly positioned at a location less than or equal to about 0.283 sectors from the first plane P1. More particularly, in FIG. 8, the second plane P2 is about 0.20 sectors from the first plane P1.

In some embodiments, the second plane P2 is angularly positioned between the first and the reference planes P1, P0 at a location between about 0.14 and about 0.21 sectors from the first plane P1. In further embodiments, the second plane P2 is also at a location greater than or equal to about 0.05 sectors from the first plane P1. The specific location of the second plane P2, and hence the second rib 270*b*, can be optimized based upon particular design and/or operational characteristics of the fan 210. However, placing the second rib 270*b* within 0.283 sectors of the first plane P1 helps provide targeted reinforcement to the hub 214 in the region proximate the intersection of the first edges 254 with the cylindrical portion 226 to reduce the deflection of the hub 214 and the resultant stresses in the hub 214. It can be noted that in some embodiments, the second plane P2 need not intersect the central axis 230, which would be the case if the rib 270*b* were not oriented in a truly radial manner relative to the cylindrical portion 226 of the hub 214. However, the rib 270*b* could still be positioned at the locations set forth above.

A third rib 270*c* is coupled to the hub 214 and is substantially aligned with a third plane P3 that intersects the central axis 230 and that is angularly positioned between the second and the reference planes P2, P0. In some embodiments, the second plane P2 and the third plane P3 are spaced from one another by at least about four degrees. In FIG. 8, the second and third planes P2 and P3 are shown spaced apart by about thirty degrees. As shown in FIG. 8, the third plane P3 lies between an intersection of the second edge 266 of the second blade 242*b* with the hub 214 and an intersection of the first edge 254 of the second blade 242*b* with the hub 214 (i.e., within the span of the root 246 of the second blade 242*b*). As shown, the third plane P3 is about five to seven degrees away from the intersection of the second edge 266 of the second blade 242*b* with the hub 214. The third rib 270*c* provides additional reinforcement to the hub 214.

A fourth rib 270*d* is coupled to the hub 214 and is substantially aligned with the reference plane P0. The first rib 270*a*, the second rib 270*b*, the third rib 270*c*, and the fourth rib 270*d* together define a first 4-rib grouping pattern spanning one sector S of the hub 214. The 4-rib grouping pattern is repeated around the entire three hundred-sixty degrees of the hub 214 such that there is an identical 4-rib grouping pattern for each blade 242 of the fan. Specifically, the ribs 270*d*, 270*e*, 270*f*, and 270*g* form a second 4-rib grouping pattern that is identical to the first 4-rib grouping pattern. Note that the fourth rib 270*d* is part of the first 4-rib grouping pattern, but is also part of the second 4-rib grouping pattern. Likewise, the ribs 270*g*, 270*h*, 270*i*, and 270*j* form an identical third 4-rib grouping pattern, the ribs 270*j*, 270*k*, 270*l*, and 270*m* form an identical fourth 4-rib grouping pattern, and the ribs 270*m*, 270*n*, 270*o*, and 270*a* form an identical fifth 4-rib grouping pattern. The number of 4-rib grouping patterns corresponds to the number of blades 242, i.e., there are five blades 242 and five 4-rib grouping patterns. The number of sectors S also correlates to the number of blades 242.

Of further significance is the number of ribs per sector S. There are five sectors S and fifteen ribs 270*a-o*. Therefore, the fan 210 can be said to have three ribs per sector S. In this regard, the ribs 270*a*, 270*b*, and 270*c* can be associated with a first sector S, while the ribs 270*d*, 270*e* and 270*f* can be associated with a second sector S. The sectors S are defined by the planes (e.g., P1 and P0), and not necessarily the ribs. In other embodiments, there can be at least three ribs per sector (e.g., four or more ribs per sector S). Since the number of sectors S is also equal to the number of blades 242, the fan 210 can also be said to have at least three ribs per blade.

As also seen in FIGS. 7 and 8, the entire root 246 of the first blade 242*a* is positioned on a first side of the second plane P2 (and therefore of the second rib 270*b*), while the entire root 246 of the second blade 242*b* is on a second side of the second plane P2 (and therefore the second rib 270*b*) opposite the first side. Therefore, the second rib 270*b* is positioned angularly between the first and second blades 242*a*, 242*b*, and not within the vicinity of the cylindrical portion 226 where a root 246 of either of the first or second blades 242*a*, 242*b* joins the hub 214.

Figure 9:
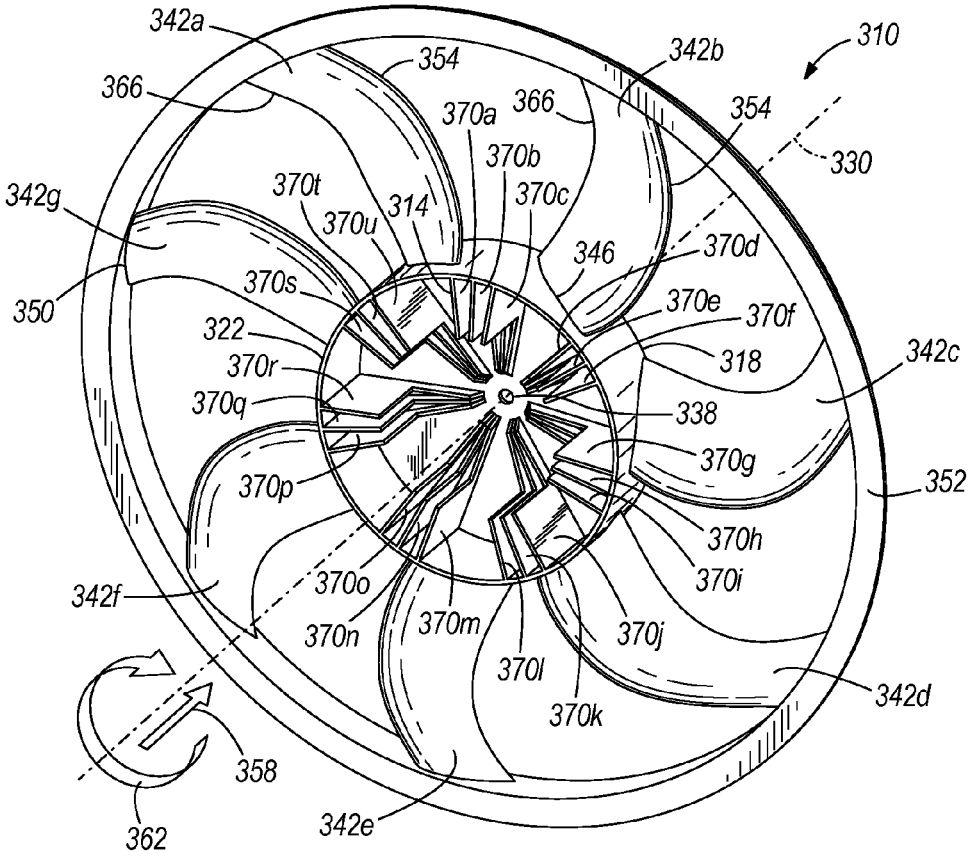
FIG. 9 is a perspective view of an axial-flow fan that is a fifth embodiment of the present invention.
Figure 10:
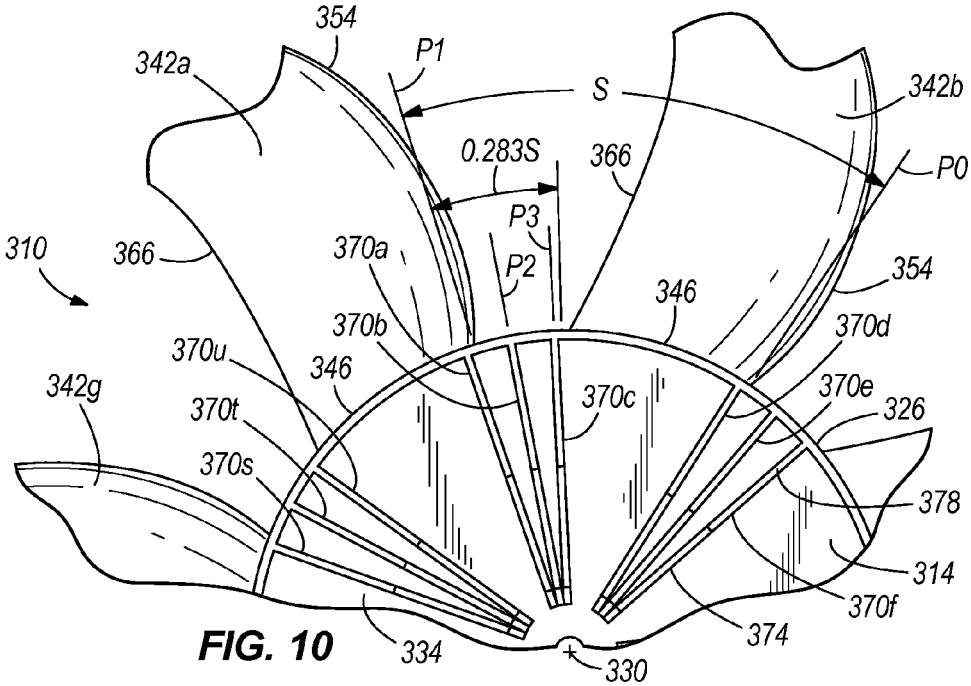
FIG. 10 is a partial end view of the fan of FIG. 9.

FIGS. 9 and 10 illustrate a fan 310 that is a fifth embodiment of the invention. The fan 310 is similar to the fan 210, but it includes seven blades instead of five. Features of the fan 310 that are similar to the fan 210 have been given the same reference numerals of the three-hundred series.

As shown in FIG. 9, twenty-one ribs 370*a-u* are coupled to the hub 314. As shown in FIG. 10, a first rib 370*a* is coupled to the hub 314 and is substantially aligned with a first plane P1 that intersects the central axis 330 and an intersection point of the first edge 354 of the first blade 342*a* with the cylindrical portion 326 of the hub 314. As used herein and in the appended claims, the phrase "substantially aligned", as used to describe the alignment of a rib with a plane, means that the radial centerline of the rib can be within plus or minus four degrees of the plane.

The first plane P1 is angularly spaced from a reference plane P0 that intersects the central axis 330 and an intersection point of the first edge 354 of the second blade 342*b* with the cylindrical portion 326 of the hub 314. As shown in FIG. 10, the planes P1 and P0 are substantially aligned with the radial centerlines of the ribs 370*a* and 370*d*, respectively. An angular spacing between the first plane P1 and the reference plane P0 (in a clockwise direction from P1 to P0 as shown in FIG. 10) defines one sector S. A second rib 370*b* is coupled to the hub 314 and is substantially aligned with a second plane P2 that intersects the central axis 330 and that is angularly positioned between the first plane P1 and the reference plane P0 at a location less than or equal to about (1/nR−0.05) sectors from the first plane P1, in which nR equals three (i.e., twenty-one ribs 370*a-u* divided by seven blades 342*a-g*). Accordingly, the second plane P2 is angularly positioned at a location less than or equal to about 0.283 sectors from the first plane P1. More particularly, in FIGS. 9 and 10, the second plane P2 is about 0.14 sectors from the first plane P1.

In some embodiments, the second plane P2 is angularly positioned between the first and the reference planes P1, P0 at a location between about 0.14 and about 0.21 sectors from the first plane P1. In further embodiments, the second plane P2 is also at a location greater than or equal to about 0.05 sectors from the first plane P1. The specific location of the second plane P2, and hence the second rib 370*b*, can be optimized based upon particular design and/or operational characteristics of the fan 310. However, placing the second rib 370*b* within 0.283 sectors of the first plane P1 helps provide targeted reinforcement to the hub 314 in the region proximate the intersection of the first edges 354 with the cylindrical portion 326 to reduce the deflection of the hub 314 and the resultant stresses in the hub 314. It can be noted that in some embodiments, the second plane P2 need not intersect the central axis 330, which would be the case if the rib 370*b* were not oriented in a truly radial manner relative to the cylindrical portion 326 of the hub 314. However, the rib 370*b* could still be positioned at the locations set forth above.

A third rib 370*c* is coupled to the hub 314 and is substantially aligned with a third plane P3 that intersects the central axis 330 and that is angularly positioned between the second plane P2 and the reference plane P0. In some embodiments, the second plane P2 and the third plane P3 are spaced from one another by at least about four degrees. In FIG. 10, the second and third planes P2 and P3 are shown spaced apart by about nine degrees. In some embodiments, the third plane P3 may lie between an intersection of the second edge 366 of the second blade 342*b* with the hub 314 and an intersection of the first edge 354 of the second blade 342*b* with the hub 314 (i.e., within the span of the root 346 of the second blade 342*b*). The third rib 370*c* provides additional reinforcement to the hub 314.

A fourth rib 370*d* is coupled to the hub 314 and is substantially aligned with the reference plane P0. The first rib 370*a*, the second rib 370*b*, the third rib 370*c*, and the fourth rib 370*d* together define a first 4-rib grouping pattern spanning one sector S of the hub 314. The 4-rib grouping pattern is repeated around the entire three hundred-sixty degrees of the hub 314 such that there is an identical 4-rib grouping pattern for each blade 342 of the fan. Specifically, the ribs 370*d*, 370*e*, 370*f*, and 370*g* form a second 4-rib grouping pattern that is identical to the first 4-rib grouping pattern. Note that the fourth rib 370*d* is part of the first 4-rib grouping pattern, but is also part of the second 4-rib grouping pattern. Likewise, the ribs 370*g*, 370*h*, 370*i*, and 370*j* form an identical third 4-rib grouping pattern, the ribs 370*j*, 370*k*, 370*l*, and 370*m* form an identical fourth 4-rib grouping pattern, the ribs 370*m*, 370*n*, 370*o*, and 370*p* form an identical fifth 4-rib grouping pattern, the ribs 370*p*, 370*q*, 370*r*, and 370*s* form an identical sixth 4-rib grouping pattern, and the ribs 370*s*, 370*t*, 370*u*, and 370*a* form an identical seventh 4-rib grouping pattern. The number of 4-rib grouping patterns corresponds to the number of blades 342, i.e., there are seven blades 342 and seven 4-rib grouping patterns. The number of sectors S also correlates to the number of blades 342.

Of further significance is the number of ribs per sector S. There are seven sectors S and twenty-one ribs 370*a-u*. Therefore, the fan 310 can be said to have three ribs per sector S. In this regard, the ribs 370*a*, 370*b*, and 370*c* can be associated with a first sector S, while the ribs 370*d*, 370*e* and 370*f* can be associated with a second sector S. The sectors S are defined by the planes (e.g., P1 and P0), and not necessarily the ribs. In other embodiments, there can be at least three ribs per sector (e.g., four or more ribs per sector S). Since the number of sectors S is also equal to the number of blades 342, the fan 310 can also be said to have at least three ribs per blade.

As also seen in FIGS. 9 and 10, the entire root 346 of the first blade 342*a* is positioned on a first side of the second plane P2 (and therefore of the second rib 370*b*), while the entire root 346 of the second blade 342*b* is on a second side of the second plane P2 (and therefore the second rib 370*b*) opposite the first side. Therefore, the second rib 370*b* is positioned angularly between the first and second blades 342*a*, 342*b*, and not within the vicinity of the cylindrical portion 326 where the root 346 of either of the first or second blades 342*a*, 342*b* joins the hub 314.

Although not shown in the drawings, other embodiments of the fan may include up to seven ribs per sector (i.e., $2 \leqq nR \leqq 7$).

Various features of the invention are set forth in the following claims.

What is claimed is:

1. An axial-flow fan comprising:

a hub including an open end and a substantially closed end, the hub defining a central axis;

a plurality of blades coupled to the hub and extending radially outwardly from the hub, each blade having a root coupled to the hub, a tip spaced from the hub, a first edge proximate the open end of the hub and interconnecting the root and the tip, the first edge defining one of a leading edge and a trailing edge with respect to a rotational direction of the hub about the central axis, and a second edge proximate the substantially closed end of the hub and interconnecting the root and the tip, the second edge defining the other of the leading edge and the trailing edge; and a plurality of ribs coupled to the hub, including a first rib substantially aligned with a first plane intersecting the central axis and an intersection of the first edge of a first of the plurality of blades with the hub, at the root of the first blade, wherein an angular spacing between the first plane and a reference plane intersecting the central axis and an intersection of the first edge of a second of the plurality of blades with the hub, at the root of the second blade, defines one sector, and a second rib substantially aligned with a second plane angularly positioned between the first plane and the reference plane, at a location less than or equal to about (1/nR−0.05) sectors from the first plane in which nR equals the number of ribs divided by the number of blades;

wherein the entire root of the first blade is positioned on a first side of the second plane, and wherein the entire root of the second blade is positioned on a second side of the second plane opposite the first side.

2. The axial-flow fan of claim 1, wherein the second plane is at a location greater than or equal to about 0.05 sectors from the first plane.

3. The axial-flow fan of claim 1, wherein nR equals two, and wherein the second plane is angularly positioned between the first plane and the reference plane at a location between about 0.15 and about 0.35 sectors from the first plane.

4. The axial-flow fan of claim 1, wherein nR equals three, and wherein the second plane is angularly positioned between the first plane and the reference plane at a location between about 0.14 and about 0.21 sectors from the first plane.

5. The axial-flow fan of claim 1, wherein the first edge of each blade defines the trailing edge, and wherein the second edge of each blade defines the leading edge.

6. The axial-flow fan of claim 1, wherein the first edge of each blade defines the leading edge, and wherein the second edge of each blade defines the trailing edge.

7. The axial-flow fan of claim 1, further comprising a third rib substantially aligned with the reference plane.

8. The axial-flow fan of claim 7, wherein the first, second, and third ribs together define a first 3-rib grouping pattern, wherein the fan further includes additional ribs defining additional 3-rib grouping patterns identical to the first 3-rib grouping pattern, and wherein the fan has a total number of 3-rib grouping patterns equal to the number of blades in the plurality of blades.

9. The axial-flow fan of claim 1, further comprising a third rib coupled to the hub and substantially aligned with a third plane angularly positioned between the second plane and the reference plane.

10. The axial-flow fan of claim 9, further comprising a fourth rib substantially aligned with the reference plane, wherein the first, second, third, and fourth ribs together define a first 4-rib grouping pattern, wherein the fan further includes additional ribs defining additional 4-rib grouping patterns identical to the first 4-rib grouping pattern, and wherein the fan has a total number of 4-rib grouping patterns equal to the number of blades in the plurality of blades.

11. The axial-flow fan of claim 1, wherein the hub includes a face portion defining the closed end and a cylindrical portion coaxial with the central axis, and wherein each rib includes a radially-extending portion coupled to the face portion, and an axially-extending portion coupled to the cylindrical portion.

12. The axial-flow fan of claim 1, wherein the number of blades in the plurality of blades equals the number of sectors defined by the fan, and wherein the fan includes at least two ribs per sector.

13. The axial-flow fan of claim 12, wherein the fan includes at least five blades.

14. The axial-flow fan of claim 12, wherein nR equals two, and wherein the second plane is angularly positioned between the first plane and the reference plane at a location less than or equal to about 0.45 sectors from the first plane.

15. The axial-flow fan of claim 1, wherein the number of blades in the plurality of blades equals the number of sectors defined by the fan, and wherein the fan includes at least three ribs per sector.

16. The axial-flow fan of claim 15, wherein the fan includes at least three blades.

17. The axial-flow fan of claim 15, wherein nR equals three, and wherein the second plane is angularly positioned between the first plane and the reference plane at a location less than or equal to about 0.283 sectors from the first plane.

18. The axial-flow fan of claim 1, further comprising a third rib coupled to the hub and aligned with a third plane angularly positioned between the second plane and the reference plane, the second and the third planes being angularly spaced from one another by at least about four degrees.

19. The axial-flow fan of claim 18, wherein the third plane lies between an intersection of the second edge of the second of the plurality of blades with the hub and an intersection of the first edge of the second of the plurality of blades with the hub.

20. The axial-flow fan of claim 18, further comprising a fourth rib coupled to the hub and aligned with the reference plane.

21. The axial-flow fan of claim 20, wherein the third plane and the reference plane are angularly spaced from one another by at least about 4 degrees.

* * * * *